US007546080B2

(12) United States Patent
Tanaka et al.

(10) Patent No.: US 7,546,080 B2
(45) Date of Patent: Jun. 9, 2009

(54) IMAGE FORMING APPARATUS

(75) Inventors: Atsushi Tanaka, Kashihara (JP); Kenji Asakura, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 224 days.

(21) Appl. No.: 11/790,569

(22) Filed: Apr. 26, 2007

(65) Prior Publication Data

US 2007/0253757 A1 Nov. 1, 2007

(30) Foreign Application Priority Data

Apr. 26, 2006 (JP) ..... P2006-122714

(51) Int. Cl.
*G03G 15/20* (2006.01)

(52) U.S. Cl. ..... 399/340; 399/45

(58) Field of Classification Search ..... 399/340, 399/45

See application file for complete search history.

(56) References Cited

U.S. PATENT DOCUMENTS 5,890,043 A 3/1999 Uehara
6,947,700 B2 * 9/2005 Kurotori et al. ..... 399/340
7,046,952 B2 * 5/2006 Kurotori et al. ..... 399/340
2004/0131402 A1 7/2004 Kurotori et al.
2005/0254867 A1 * 11/2005 Kurotori et al. ..... 399/340

FOREIGN PATENT DOCUMENTS

JP 10-63121 A 3/1998
JP 2004-109747 A 4/2004
JP 2004-151626 A 5/2004

* cited by examiner

*Primary Examiner*—David M Gray
*Assistant Examiner*—G. M. Hyder
(74) *Attorney, Agent, or Firm*—Nixon & Vanderhye, P.C.

(57) ABSTRACT

There is provided an image forming apparatus involving wet fixing that causes no bleeding and coagulation of toner and eventually no disturbance of toner image as a result of application of a fixing fluid, generates no curling or wrinkles in a recording medium, and can fix toner with large adhesion on a recording medium through which the fixing fluid hardly permeates. An image forming apparatus includes a toner image forming section, an intermediate transfer section, a transfer section, a fixing fluid applying section, a transport section, a fixing section, a recording medium feeding section, and a recording medium detection section. In the image forming apparatus, control of application amount of a fixing fluid to a recording medium is performed by the fixing fluid applying section based on the result obtained by the recording medium detection section for the recording medium such as thickness and material.

11 Claims, 5 Drawing Sheets

IMAGE FORMING APPARATUS

CROSS-REFERENCE TO RELATED APPLICATION

This application claims priority to Japanese Patent Application No. 2006-122714, which was filed on Apr. 26, 2006, the contents of which, are incorporated herein by reference, in their entirety.

BACKGROUND OF THE INVENTION

1. Field of the Invention

The present invention relates to an image forming apparatus.

2. Description of the Related Art

An electrophotographic image forming apparatus is popular for use in a copier, printer, facsimile, and the like. In the electrophotographic image forming apparatus, a toner image is transferred directly to a recording medium, e.g., paper, or indirectly thereto after a transfer to an intermediate transfer medium. For such a toner image transfer, used is a photoreceptor having a photosensitive layer including a photoconductive substance formed on the surface thereof. The surface of the photoreceptor is subjected to electric charge injection so that it is uniformly charged, and then an electrostatic latent image is so formed as to correspond to image information by going through various image formation processes. The electrostatic latent image is then developed with a supply of developing agent including a toner from a developing section. The result is a toner image for transfer to a recording medium. To fix thus transferred toner image onto the recording medium, a thermal fixing section is generally used to heat and apply pressure to the recording medium. The fixing section includes a heating section, and uses a developer roller or the like.

The thermal-fixing image forming apparatus is exemplified by a type of transferring and fixing a toner image to a recording medium while heating an intermediate transfer belt, and eventually the toner image being a target for transfer onto the intermediate transfer belt. The intermediate transfer belt here is a medium for use for intermediate transfer, and is placed across a heating roller. As an example, refer to Japanese Unexamined Patent Publication JP-A 10-63121 (1998). The image forming apparatus of JP-A10-63121 has characteristics that the power consumption is relatively low. The issue here is that, in the image forming apparatus, a recording medium is not heated, and when a toner image comes into contact with a recording medium at the time of thermal fixing, the toner image is reduced in temperature. This disadvantageously causes not-fully fixing of the toner image, and image degradation such as offset. There is proposed another image forming apparatus of a type of transferring and fixing a toner image to a recording medium while heating both the toner image on an intermediate transfer belt, and the recording medium before the transfer fixing of the toner image. As an example, refer to Japanese Unexamined Patent Publication JP-A2004-151626. The issue here is that, with the image forming apparatus of JP-A 2004-151626, although the toner image is indeed better fixed to the recording medium, the apparatus requires a larger thermal capacity for a heating section as is heating not only the toner image but also the recording medium. This resultantly increases the power consumption, and the resulting increased amount of power consumption makes up more than one half of the entire amount.

However, energy saving is aimed at as a measure for prevention of global warming. With the recent popularity of an electrophotographic image forming apparatus, the reduction of power consumption is also required for the electrophotographic image forming apparatus at the time of toner image fixing to a recording medium. With thermal fixing, because the heating section is used in the apparatus as described above, there needs to increase the heat resistance for other components in the high-temperature apparatus. This resultantly increases the material cost. Also with thermal fixing, no image fixing is possible until a portion for image fixing reaches a predetermined temperature, thereby taking long to derive the temperature of a predetermined value, i.e., taking long warm-up time. Also with thermal fixing, a multicolor toner image takes long to be fixed to a recording medium compared with a single-color toner image. There thus is a demand for shorter fixing time for a multicolor toner image. To meet such a demand, there is proposed wet fixing, which uses a fixing fluid including water and a liquid which can be dissolved or dispersed in water, and can soften or swell a toner. With such wet fixing, a toner image is softened or swollen by the action of a fixing fluid before being attached to a recording medium, and a pressure is applied thereto so that the toner image is fixed to the recording medium. Such wet fixing consumes much less power than thermal fixing, and thus is considered useful in terms of energy conservation. In terms of fixing time for a multicolor toner image, because wet fixing does not require that much amount of heat, the fixing time can be reduced compared with thermal fixing. As such, there are proposed various improvements for such wet fixing.

One proposal is of an image fixing apparatus that applies a fixing fluid only to a portion to be fixed with a toner, and heats the fixing fluid. The fixing fluid is applied from a fixing fluid ejection member formed with a plurality of minute holes, and is directed to a toner image on an intermediate transfer medium or a recording medium. As an example, refer to Japanese Unexamined Patent Publication JP-A 2004-109747. That is, in the image fixing apparatus, a fixing fluid is applied to a toner image on an intermediate transfer medium or a recording medium before a heating process. The concern here is that, at ambient temperature, an unfixed toner image is merely a cluster of toner particles with no physical or chemical bonding. Therefore, when a liquid substance, e.g., fixing fluid, is applied directly to such an unfixed toner image, the toner particles apt to bleed or coagulate before being strongly bound together through softening and/or swelling. This causes the resulting fixed image look blurred at the edges, and have inconsistencies at halftone portions that are supposed to show uniformity, thereby being unable to provide the high image quality. The heating process after the bleeding or coagulation of the toner particles does surely not put the particles back to their original state.

In the image fixing apparatus of JP-A 2004-109747, when an intermediate transfer medium bears thereon a toner image, the intermediate transfer belt, which is an intermediate transfer medium, is subject to water-repellent treatment such as a treatment with fluorine. This allows, when a fixing fluid is applied to an area of the intermediate transfer belt for toner image formation, the fixing fluid to stay at portions where a toner is attached in the toner image formation area, i.e., image sections, but not at portions where no toner is attached in any area between the toner-attached portions, i.e., no-image sections. The problem here is that when a fixing fluid remains only at the image sections in a recording medium as such, the image sections expand and contract but not the no-image sections. There is thus no way of avoiding the image sections and therearound from becoming wrinkled. Especially when a recording medium is paper made by filtering the paper fiber using water, the wrinkles become more pronounced.

Although such an inconvenience is surely prevented if with the minimum amount of fixing fluid needed for swelling of the toner, the minimum amount is extraordinarily small, whereby it is difficult to measure the minimum amount with precision. When a fixing fluid is applied only to the image sections, background fogging or the like occur because some of the toner attaches the no-image sections around the image sections, and the toner is not fixed and thus remains on the recording medium, thereby sometimes making a user's hands and clothes dirty.

In the image forming apparatus of JP-A 10-63121, at the time of transferring and fixing a toner image on a transfer belt being heated to a not-heated recording medium, a fixing fluid may be applied to the toner image. The image forming apparatus of JP-A 10-63121, however, requires a large amount of fixing fluid if wanting to increase the adhesion between the toner image and the recording medium, and the bonding among the toner particles. This is because, in the image forming apparatus, no heat supply is made at the time of transferring and fixing a toner image, and no other specific measures are taken. The use of large amount of fixing fluid inevitably causes wrinkles and curling to a recording medium. The use of large amount of fixing fluid also causes the need for frequent supply of a fixing fluid or the need for a large-capacity storage tank for the fixing fluid. This results in poor maintainability or size increase of the apparatus. Considered here is another possible problem if the previous wet-fixing image forming apparatus uses, for fixing of a toner image, a recording medium that is less prone to be permeated with a fixing fluid, e.g., plastic sheet or coated paper including an overhead projector sheet (hereinafter, referred to as "OHP sheet"). In such a case, the adherence of the toner becomes not sufficient, thereby possibly impairing the completion of the resulting toner image.

SUMMARY OF THE INVENTION

An object of the invention is to provide an image forming apparatus involving wet fixing that causes no bleeding and coagulation of toner and eventually no disturbance of toner image as a result of application of a fixing fluid, generates no curling or wrinkles in a recording medium, can reduce an amount of power consumption and consumption of the fixing fluid, takes a relatively short time to fix even a multicolored toner image, and can fix toner with large adhesion on a recording medium through which the fixing fluid hardly permeates.

The invention provides an image forming apparatus, comprising:

a toner image forming section that forms a toner image;

a transfer section that transfers, onto a recording medium, a toner image formed by the toner image forming section;

a fixing fluid applying section that applies to the toner image on a surface of the recording medium, a fixing fluid including water and an organic solvent that softens and/or swells a toner to fix the toner to the recording medium;

a heating section that heats the recording medium;

a recording medium detection section that detects any information about the recording medium; and a fixing fluid control section that causes the fixing fluid applying section to control the amount of fixing fluid for application to the toner image, based on the result obtained by the recording medium detection section.

According to the aspect of the invention, there is provided the image forming apparatus involving wet fixing including the toner image forming section, the transfer section, the fixing fluid applying section, the heating section, the recording medium detection section, and the fixing fluid control section. The fixing fluid applying section applies a fixing fluid to make it contact with a recording medium bearing thereon a toner image. The fixing fluid control section causes the fixing fluid applying section to control the amount of fixing fluid for application to the recording medium. The recording media vary in level and speed of being permeated with a fixing fluid, for example. Considered here is an exemplary case where a fixing fluid of an appropriate amount is applied to a recording medium of a general thickness. If with the recording medium being thin paper, the supply of the fixing fluid may be too much, and if with the recording paper being thick paper, the supply of the fixing fluid may be not enough. In consideration thereof, in the image forming apparatus of the invention, the type of a recording medium is used as a basis to determine the amount of fixing fluid for application thereto. That is, when the recording medium detection section detects that a recording medium is an OHP sheet, the amount of fixing fluid for application to the recording medium is controllably reduced compared with a case that the recording medium is plain paper. Such a configuration causes no disturbance of a toner image as a result of application of the fixing fluid, generates no curling or wrinkles in a recording medium, and can fix toner with large adhesion on a recording medium through which the fixing fluid hardly permeates, e.g., OHP sheet or coated paper. The configuration also enables the fixing of a multicolor toner image in a relatively short time without causing image disturbance because a fixing fluid of an appropriate amount is applied to the toner image. Because the appropriate amount of fixing fluid is applied to the toner image, the fixing fluid is not wastefully consumed so that the consumption of the fixing fluid can be saved. What is more, with the control exercised over the application amount of fixing fluid as described above, the function of the fixing fluid is substantially maximized so that the heating by the heating section can be kept at the necessary minimum level. This thus favorably leads also to the reduction of the power consumption. Moreover, because the image forming apparatus of the invention is of wet fixing, high-quality images can be formed in a stable manner.

In the invention, it is preferable that the recording medium detection section detects a thickness of a recording medium.

According to the aspect of the invention, the recording medium detection section detects a thickness of a recording medium, and based on the result, the application amount of fixing fluid is controlled. Through such control exercise, the image forming apparatus itself takes charge of selecting, automatically, the amount of fixing fluid considered appropriate for application. This enables to form high-quality images being free from wrinkles, curling, and the like, with the high level of fixing adhesion.

In the invention, it is preferable that the recording medium detection section detects a material of a recording medium.

According to the aspect of the invention, the recording medium detection section detects a material of a recording medium, and based on the result, the application amount of fixing fluid is controlled. Through such control exercise, occurrences of problems possibly caused by the application of a fixing fluid are prevented, e.g., the bleeding and coagulation of a toner on the recording medium, and the disturbance of the resulting toner image. This thus favorably enables to form, in a stable manner, high-quality images with the sufficiently-high level of fixing adhesion of an image to a recording medium, and with the image reproducibility of a satisfactory level. When a recording medium such as OHP sheet or coated paper is less prone to be permeated with a fixing fluid, the application amount of fixing fluid is controllably reduced compared with a case where the recording medium is plain paper. With such control exercise, the bleeding, the coagulation, and the like of a toner can be successfully prevented at the time of application of a fixing fluid.

Furthermore, in the invention, it is preferable that the image forming apparatus further comprises: a transport section that transports a recording medium; and a transport speed control section that causes the transport section to control a transport speed of the recording medium, wherein in accordance with the result obtained by the recording medium detection section that the recording medium is a plastic sheet or coated paper, the transport speed control section controllably sets the transport speed of the recording medium by the transport section to a lower speed compared with the case of a recording medium being detected as plain paper.

According to the aspect of the invention, the image forming apparatus may further comprise the transport section for transporting a recording medium, and a transport speed control section. With such a configuration, when the recording medium detection section detects that a recording medium is a plastic sheet or coated paper, the transport speed control section sets the transport speed of the recording medium by the transport section to a lower speed compared with the case of a recording medium being detected as plain paper. Through such control exercise, the movement and flowing of a fixing fluid can be better prevented on the recording medium at the time of application of the fixing fluid. This favorably much reduces the tendency for a toner to bleed and coagulate, for example.

In the invention, it is preferable that the heating section heats a recording medium until the temperature reaches a value higher than a glass transition temperature of a toner constituting a toner image.

According to the aspect of the invention, when a recording medium is heated by the heating section until the temperature reaches a value higher than the glass transition temperature of a toner constituting a toner image, e.g., a temperature higher by 5 to 10° C. than the glass transition temperature, the toner is quickly softened so that the bonding is increased among the toner particles, and the adhesion is increased between the toner and the recording medium. This is achieved by the synergy between the fixing fluid and the heating. This thus enables to better prevent, without fail, at the time of application of a fixing fluid, the bleeding, the coagulation, and the like of the toner associated with the flowing of the fixing fluid. The issue here is that, with thermal fixing, even if a recording medium is heated with the temperature higher by 5 to 10° C. than the glass transition temperature of the toner, toner images cannot be smoothly fixed to a recording medium in a sequential manner.

In the invention, it is preferable that the heating section heats a recording medium to a temperature higher than a softening temperature of a toner constituting a toner image.

According to the aspect of the invention, when a recording medium is heated by the heating section until the temperature reaches a value higher than the softening temperature of a toner constituting a toner image, e.g., a temperature higher by 5 to 10° C. than the softening temperature of the toner, the toner is quickly softened so that the bonding is increased among the toner particles, and the adhesion is increased between the toner and the recording medium. This is achieved by the synergy between the fixing fluid and the heating. This thus enables to better prevent, without fail, at the time of application of a fixing fluid, the bleeding, the coagulation, and the like of the toner possibly caused by the fixing fluid.

In the invention, it is preferable that heating by the heating section and application of a fixing fluid by the fixing fluid applying section are executed to at least a toner image formation area in the recording medium.

According to the aspect of the invention, in a recording medium, at least a toner image formation area is heated and applied with a fixing fluid. Such a configuration enables to supply the heat at the moment of the application of a fixing fluid on the spot for compensating the temperature reduction of a toner and a recording medium as a result of the application of the fixing fluid. This accordingly increases the temperatures of the toner, the recording medium, and the fixing fluid immediately after the application of the fixing fluid. The resulting temperatures are higher than those when the fixing fluid is applied with no heating so that the dispersion/permeating speed of the fixing fluid is increased for the toner image immediately after the application. As a result, the toner is swollen and softened instantaneously over the wide area so that the toner image can be fixed to the recording medium in a short time, and the toner image has the adhesion of a sufficient level to the recording medium. If the fixing fluid is increased in temperature after being applied, the fixing fluid can be dried in a short time.

In the invention, it is preferable that the fixing fluid applying section further includes a fixing fluid temperature keeping section that keeps a temperature of the fixing fluid before application to the recording medium.

According to the aspect of the invention, the fixing fluid temperature keeping section is provided to keep the temperature of a fixing fluid before application to a recording medium. This fixing fluid temperature keeping section serves well to better prevent the temperature reduction of a toner after the application of the fixing fluid. That is, by keeping the temperature of the fixing fluid at the level not easily vaporizing the components in the fixing fluid, a synergistic effect is observed between the application and heating of the fixing fluid with much higher efficiency. The toner images thus can be smoothly transferred and fixed to the recording medium in a sequential manner.

In the invention, it is preferable that the fixing fluid further includes an adhesive for increasing adhesion of a toner to a recording medium.

According to the aspect of the invention, the fixing fluid further includes an adhesive together with an organic solvent and water. This favorably increases, to a further degree, the bonding among the toner particles and the adhesion between the toner and the recording medium so that the toner image can be fixed to the recording medium in a more stable manner.

In the invention, it is preferable that the toner includes a polyester component, and a wax component whose glass transition temperature is lower than that of the polyester component.

According to the aspect of the invention, the toner preferably includes a polyester component, and a wax component whose glass transition temperature is lower than that of the polyester component. The polyester component is easily swollen and softened by an organic solvent included in a fixing fluid, and after swollen and softened as such, the polyester component becomes transparent. As such, when a color toner image is fixed using the fixing fluid, the polyester component becomes transparent, and subtractive color mixing occurs so that the resulting fixed image is brightly colored. Herein, the color toner image is an overlay of toner images varying in color, and with the subtractive color mixing, only the coloring agent is made vivid and clear. The wax component has the glass transition temperature lower than that of a binding resin, and thus is easily softened by heat. The wax component thus leads to better bonding among the toner particles and better adhesion between the toner and the recording medium even at the temperature lower than the glass transition temperature of the toner. This thus enables to better prevent, without fail, at the time of application of a fixing fluid, the bleeding and the coagulation of the toner. When the wax component is softened as such, from the portion of the wax component, the fixing fluid easily penetrates into the toner particles. As such, when the fixing fluid is applied, the toner is entirely swollen and softened in a short time, and at the time of image transferring to the recording medium, a toner image can be fixed with the adhesion of a satisfactory level. The resulting toner image can be fully vivid and clear with an overlay of toner images.

In the invention, it is preferable that a volume average particle diameter of a toner is 2 to 7 μm.

According to the aspect of the invention, the toner for use in the image forming apparatus of the invention has a volume average particle diameter of 2 to 7 μm. By using such a toner, the resulting fixed image has good coloring. If with the recording medium of an OHP sheet, the fixed image thereon will look clearly transparent when the sheet is placed on an overhead projector.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
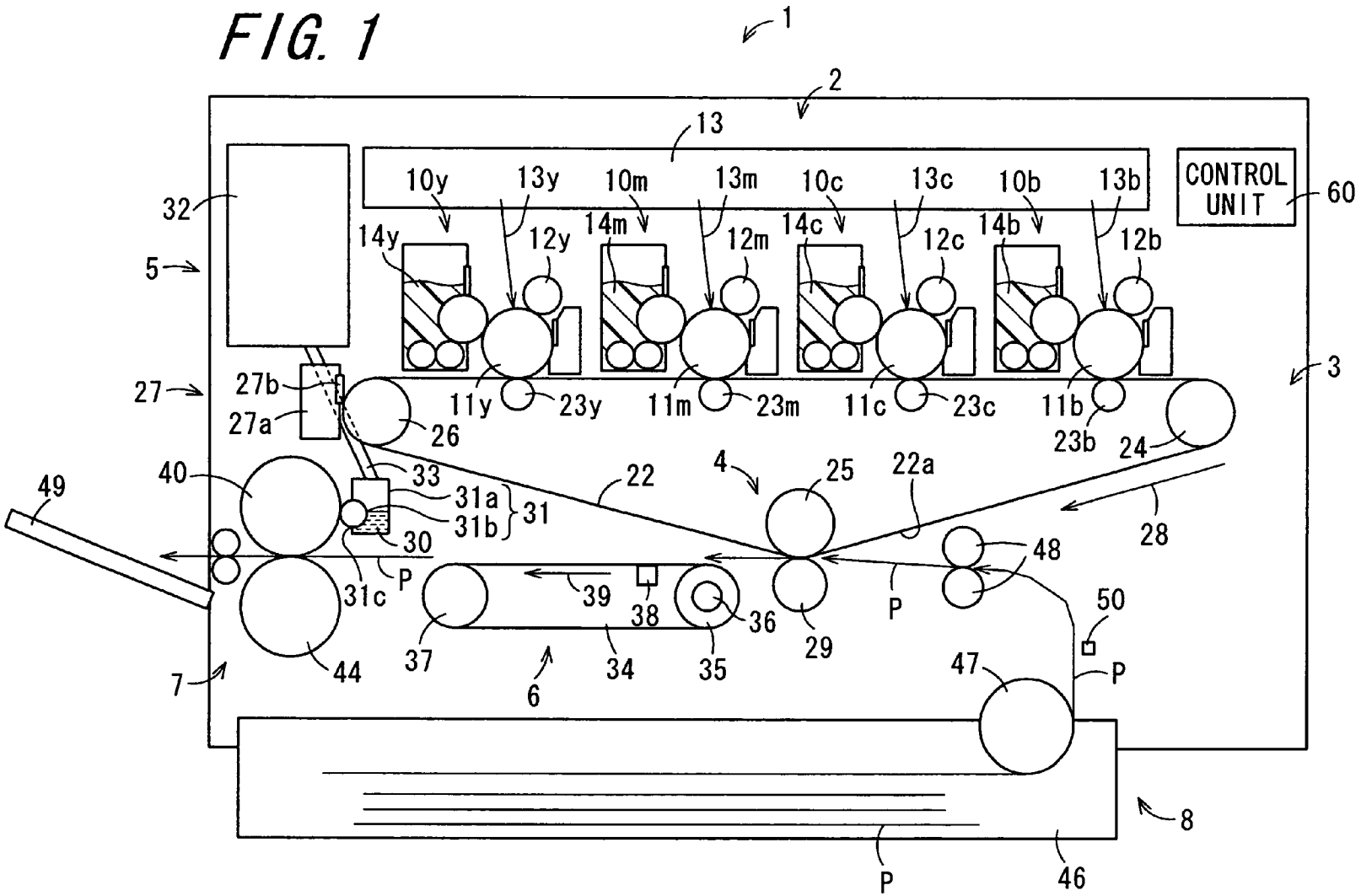
FIG. 1 is a cross sectional view schematically showing the configuration of an image forming apparatus according to a first embodiment of the invention.

Now referring to the drawings, preferred embodiments of the invention are described below.

Figure 2:
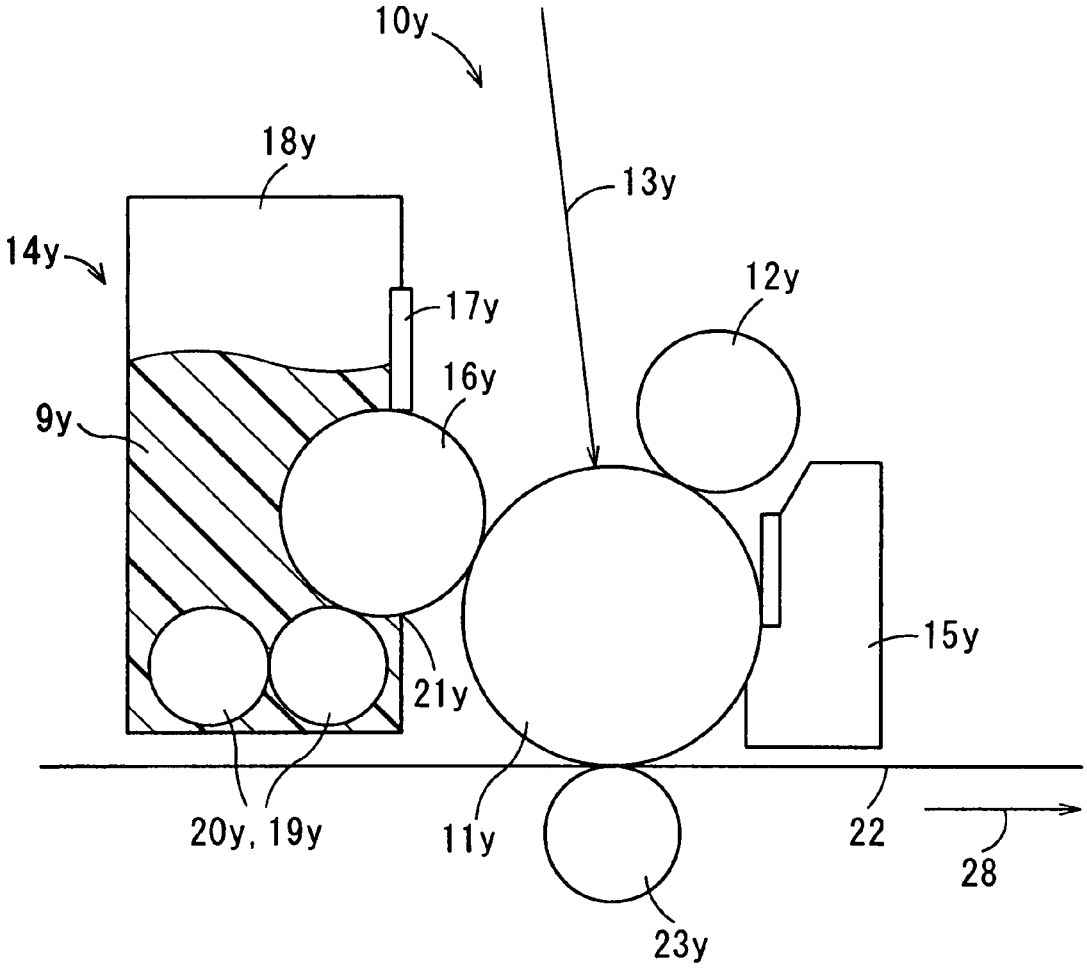
FIG. 2 is an enlarged cross sectional view of the image forming apparatus of FIG. 1.
Figure 3:
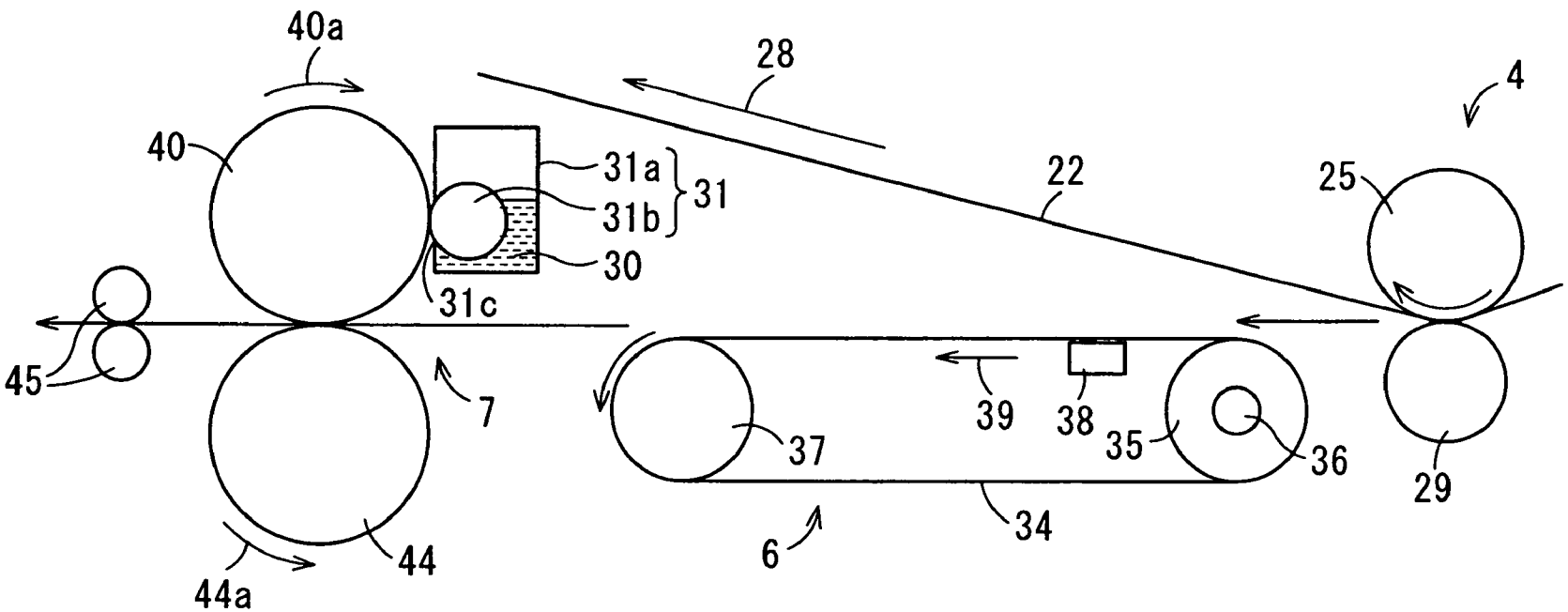
FIG. 3 is an enlarged cross sectional view of the image forming apparatus of FIG. 1.
Figure 4:
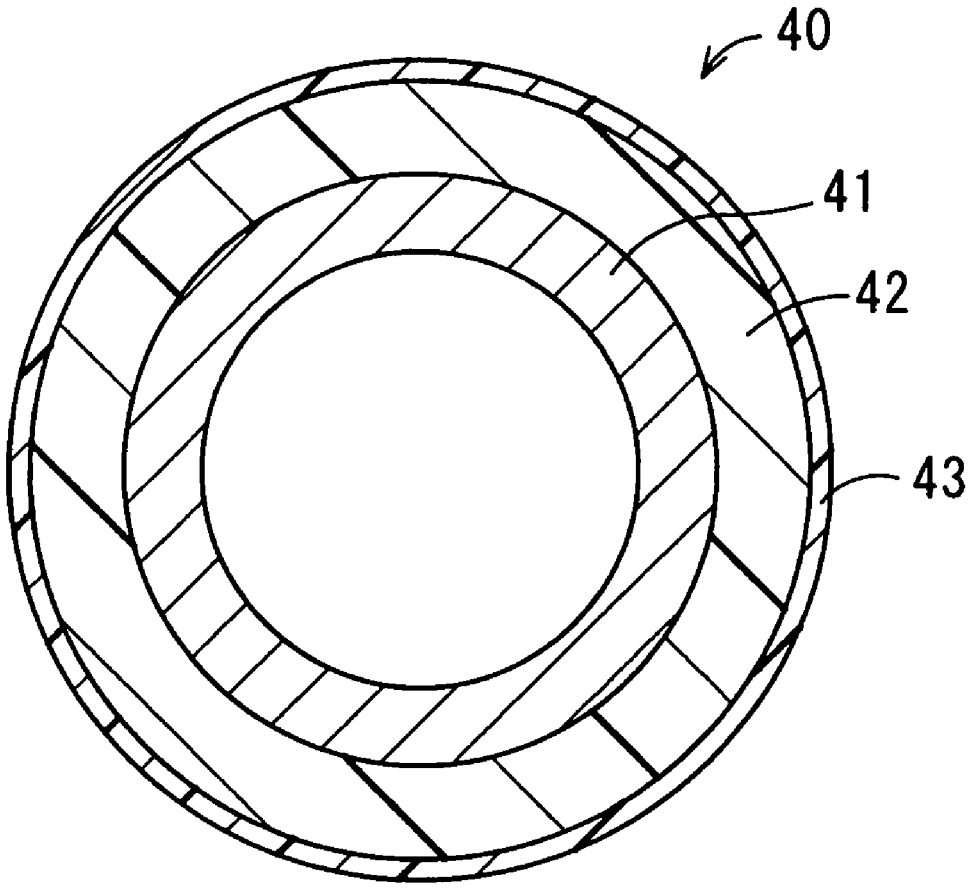
FIG. 4 is a cross sectional view schematically showing the configuration of a fixing roller used in the image forming apparatus of FIG. 1.

FIG. 1 is a cross sectional view schematically showing the configuration of an image forming apparatus 1 according to a first embodiment of the invention. FIG. 2 is an enlarged cross sectional view of the image forming apparatus of FIG. 1, showing the configuration of a main component therein, i.e., a toner image forming section 2 that will be described later. FIG. 3 is an enlarged cross sectional view of the image forming apparatus of FIG. 1, showing the configurations of main components therein, i.e., a transfer section 4, a part of a fixing fluid applying section 5, a transport section 6, and a fixing section 7, all of which will be described later. FIG. 4 is a cross sectional view schematically showing the configuration of a fixing roller 40 that will be described later. The image forming apparatus 1 is of an electrophotographic type with the tandem configuration. In the image forming apparatus 1, toner images of four colors, i.e., yellow, magenta, cyan, and black, are transferred by sequentially overlaying one image on another. The image forming apparatus 1 includes the toner image forming section 2, an intermediate transfer section 3, the transfer section 4, the fixing fluid applying section 5, the transport section 6, the fixing section 7, a recording medium feeding section 8, a recording medium detection section 50, and a fixing fluid control section and a control unit 60 serving as a transport speed control section.

The toner image forming section 2 includes image forming units 10*y*, 10*m*, 10*c*, and 10*b*. The image forming units 10*y*, 10*m*, 10*c*, and 10*b* are disposed in a line in this order in the direction of rotating and driving an intermediate transfer belt 22 (will be described later), i.e., sub-scanning direction, that is, from the upstream of the direction of an arrow 28. The image forming units 10*y*, 10*m*, 10*c*, and 10*b* each form an electrostatic latent image, supply a toner of a color corresponding to the electrostatic latent image, and form a toner image of the color after image development. The electrostatic latent images are those corresponding to image information provided as a digital signal or the like for each of the colors. That is, the image forming unit 10*y* forms a toner image corresponding to image information of yellow, the image forming unit 10*m* forms a toner image corresponding to image information of magenta, the image forming unit 10*c* forms a toner image corresponding to image information of cyan, and the image forming unit 10*b* forms a toner image corresponding to image information of black. The image forming unit 10*y* includes a photoreceptor drum 11*y*, a charging roller 12*y*, an optical scanning unit 13, a developing device 14*y*, and a drum cleaner 15*y*.

The photoreceptor drum 11*y* is a roller-shaped member that is supported by a drive mechanism (not shown) to be rotated about an axis thereof, and has a photosensitive layer formed on the surface thereof to be formed with an electrostatic latent image, and eventually a toner image. As an example, the photoreceptor drum 11*y* includes a conductive substrate (not shown), and a photosensitive layer to be formed on a surface of the conductive substrate. The conductive substrate is shaped like a cylinder, a column, a sheet, and the like, and among these, the cylindrical conductive substrate is considered preferable. The photosensitive layer can be organic, inorganic, and the like. An organic photosensitive layer is exemplified by a laminate of a resin layer including a charge generating substance and a resin layer including a charge transporting substance, a resin layer including both a charge generating substance and a charge transporting substance, or the like. An inorganic photosensitive layer is exemplified by a layer including one or more of zinc oxide, selenium, amorphous silicon, and the like. Between the conductive substrate and the photosensitive layer, a base layer may be disposed. The photosensitive layer may be provided with, on its surface, a surface layer mainly for protecting the photosensitive layer. The photoreceptor drum 11*y* in this embodiment has the diameter of 30 mm, including an aluminum tube being a conductive substrate for connection to a ground potential (GND), and an organic photosensitive layer to be formed on a surface of the aluminum tube with the thickness of 20 μm. The organic photosensitive layer is formed as a laminate of a charge generating layer and a charge transporting layer. In this embodiment, the photoreceptor drum 11*y* is rotated in a clockwise direction with the circumferential speed of 100 mm/s.

The charging roller 12*y* is a roller-shaped member that is supported by a drive mechanism (not shown) to be rotated about an axis thereof, and electrically charges the surface of the photoreceptor drum 11*y* to have a predetermined polarity and potential. The charging roller 12*y* is connected with a power supply (not shown), and receives a voltage from the power supply so that the surface of the photoreceptor drum 11*y* is electrically charged thereby. In this embodiment, the charging roller 12*y* electrically charges the surface of the photoreceptor drum 11*y* to be −600V. As an alternative to the charging roller 12*y*, a possible option includes a brush-type charger, a charging charger, a corona charger such as scorotron, or the like.

The optical scanning unit 13 irradiates a signal light 13*y* corresponding to the image information of yellow to the surface of the photoreceptor drum 11*y*, which is electrically charged by the charging roller 12*y*. As a result of such light exposure, on the surface of the photoreceptor drum 11*y* is formed an electrostatic latent image corresponding to the image information of yellow. The optical scanning unit 13 is exemplified by a semiconductor laser or the like. In this embodiment, an electrostatic latent image with an exposure potential of −70V is formed on the surface of the photoreceptor drum 11*y* that is electrically charged to be −600V.

The developing device 14*y* is configured to include a developing roller 16*y*, a developing blade 17*y*, a developing tank 18*y*, and stirring rollers 19*y* and 20*y*. The developing roller 16*y* bears on the surface thereof a yellow toner 9*y*, which is supplied to the electrostatic latent image on the surface of the photoreceptor drum 11*y* at a portion most proximal to the developing roller 16*y* and the photoreceptor drum 11*y*, i.e., developing nip portion. The developing roller 16*y* is a roller-shaped member that is housed in the developing tank is 18*y*, and is partially protruded toward outside from an aperture portion 21*y*, which is formed to the surface of the developing tank 18*y* facing the photoreceptor drum 11*y*. The developing roller 16*y* is pressed against the photoreceptor drum 11*y*, and is so disposed as to be rotated about an axis thereof. The developing roller 16*y* includes therein a fixed magnetic pole. The developing roller 16*y* and the photoreceptor drum 11*y* rotate in the directions opposite to each other. As such, a tangent component in the rotation direction of the developing roller 16*y* at the developing nip portion and a tangent component in the rotation direction of the photoreceptor drum 11*y* at the developing nip portion are the same direction. The developing roller 16*y* is connected with a power supply (not shown), and receives a direct voltage, i.e., developing voltage, from the power supply. With such a voltage supply, the yellow toner 9*y* on the surface of the developing roller 16*y* is smoothly provided to the electrostatic latent image. In this embodiment, the developing roller 16*y* rotates with the circumferential speed of 150 mm/s, which is about one-and-a-half times faster than the circumferential speed of the photoreceptor drum 11*y*. To the developing roller 16*y*, the direct voltage of −240V is applied as the developing potential. The yellow toner layer on the surface of the developing roller 16*y* comes in contact with the photoreceptor drum 11*y* at the developing nip portion so that the electrostatic latent image is provided with the yellow toner 9*y*.

The developing blade 17*y* is a plate-like member that is so disposed that one end is supported by the developing tank 18*y*, and the other end is pressed against the surface of the developing roller 16*y*. The developing blade 17*y* uniforms the layer of the yellow toner layer borne on the surface of the developing roller 16*y* and controls the layer thickness. The developing tank 18*y* is a container-like member that is formed with the aperture portion 21*y* on the surface facing the photoreceptor drum 11*y* as described above, and has an internal space therein. The developing tank 18*y* includes, in the internal space, the developing roller 16*y* and the stirring rollers 19*y* and 20*y*, and stores therein the yellow toner 9*y*. The developing tank 18*y* is supplied with the yellow toner 9*y* from a toner cartridge (not shown) depending on how much of the yellow toner 9*y* is consumed. In this embodiment, the yellow toner 9*y* is of a dual-component developing agent being the mixture with a magnetic carrier. This is surely not restrictive, and a possible option is a single-component developing agent including only the yellow toner 9*y*.

The stirring rollers 19*y* and 20*y* are each a screw-shaped roller member provided in the internal space of the developing tank 18*y* to be pressed against each other, and to rotate about an axis thereof. The stirring roller 19*y* is so disposed as to face the developing roller 16*y*, and to be pressed against the developing roller 16*y*. The stirring rollers 19*y* and 20*y* are each rotated, and mix together the yellow toner 9*y* which is supplied into the developing tank 18*y* from the toner cartridge (not shown) and the magnetic carrier which is previously filled in the developing tank 18*y* and supply the mixture to the developing roller 16*y* and a periphery thereof.

In this embodiment, the components, i.e., the photoreceptor drum 11*y*, the developing roller 16*y*, the developing blade 17*y*, and the stirring rollers 19*y* and 20*y*, are provided to be pressed against one another. This is surely not restrictive, and the components may be disposed with a space, i.e., between the photoreceptor drum 11*y* and the developing roller 16*y*, between the developing roller 16*y* and the developing blade 17*y*, between the developing roller 16*y* and the stirring roller 19*y*, and between the stirring rollers 19*y* and 20*y*.

The drum cleaner 15*y* transfers the yellow toner image on the surface of the photoreceptor drum 11*y* to the intermediate transfer belt 22, and then removes and collects the yellow toner 9*y* remained on the surface of the photoreceptor drum 11*y*. The details are left for later description.

In the image forming unit 10*y*, the optical scanning unit 13 irradiates the surface of the photoreceptor drum 11*y* which is in the electrically-charged state by the charging roller 12*y*, with the signal light 13*y* corresponding to the image information of yellow so that an electrostatic latent image is formed. Thus formed electrostatic latent image is developed with a supply of the yellow toner 9*y* coming from the developing device 14*y* so that a yellow toner image is formed. This yellow toner image is transferred to the intermediate transfer belt 22, which is rotated in the direction of the arrow 28 while being pressed against the surface of the photoreceptor drum 11*y*. The details are left for later description. The yellow toner 9*y* remained on the surface of the photoreceptor drum 11*y* is removed and collected by the drum cleaner 15*y*. This operation, i.e., image (toner image) forming operation, is repeatedly executed. The image forming units 10*m*, 10*c*, and 10*b* are each similar in configuration to the image forming unit 10*y* except using a magenta toner 9*m*, a cyan toner 9*c*, or a black toner 9*b* instead of the yellow toner 9*y*. As to the reference numerals of the image forming units, i.e., 10*m*, 10*c*, and 10*b*, "m" stands for magenta, "c" stands for cyan, and "b" stands for black, and no detailed description is given therefor.

The toners 9*y*, 9*m*, 9*c*, and 9*b* (hereinafter, collectively referred to as "toner 9" unless otherwise specified) each include a binding resin, a coloring agent, and a release agent. The binding resin is not specifically restrictive as long as it is swollen or softened by a fixing fluid 30 that will be described later, e.g., polystyrene, homopolymer of styrene substitution, styrene copolymer being a copolymer of two or more monomers selected from styrene and styrene substitution, polyvinyl chloride, polyvinyl acetate, polyethylene, polypropylene, polyester, and polyurethane. Among them, the binding resin may be used alone or in combination of two or more. The binding resin for use with a color toner preferably has the softening temperature of 100 to 150° C., and the glass transition temperature of 50 to 80° C. in terms of storage, durability, control over the swelling and softening by the fixing fluid 30 or the like, and polyester is considered especially preferable with the above softening temperature and glass transition temperature. The polyester biding resin is easily swollen and softened by an easy-to-get organic solvent, and after swollen and softened as such, the polyester resin becomes transparent. If with such a polyester binding resin, when a multicolor toner image is fixed to a recording medium P using the fixing fluid 30, the polyester component becomes transparent so that the resulting image looks clear and vivid by subtractive color mixing. The multicolor toner image here is an overlay of two or more toner images of yellow, magenta, cyan, and black. Even if a resin for use has the softening temperature higher than a binding resin in a toner for use with thermal fixing or has the molecular weight higher than that, the resin can be used for image fixing with the fixing fluid 30. Using a resin with the higher softening temperature or the higher molecular weight will prevent deterioration possibly caused by the load at the time of image development, and the resulting image can be of high quality for a long time. In this embodiment, used is a polyester resin with the glass transition temperature of 60° C., and the softening temperature of 120° C.

The coloring agent is exemplified by a toner pigment and a dye, which have been popular for electrophotographic image forming. Most of all, a pigment not dissolved in the fixing fluid 30 is considered preferable to prevent edge blurring when a toner image is transferred and fixed to the recording medium P with the application of the fixing fluid 30. The pigment is exemplified by an organic pigment, an inorganic pigment, or a metal powder. Examples of the organic pigment include: azo pigment, benzimidazolone pigment, quinacridone pigment, phthalocyanine pigment, isoindolinone pigment, isoindoline pigment, dioxazine pigment, anthraquinone pigment, perylene pigment, perinone pigment, thioindigo pigment, quinophthalone pigment, metal complex pigment, and the like. Examples of the inorganic pigment include: carbon black, titanium oxide, molybdenum red, chrome yellow, titanium yellow, chromium oxide, Berlin blue, and the like. The metal powder includes aluminum powder. Among them, the pigment may be used alone or in combination of two or more.

The release agent is exemplified by a wax. The wax is preferably the one regularly used in this field, and most of all, the wax that swells or softens by the fixing fluid 30 is considered preferable. Examples of such a wax include, specifically, polyethylene wax, polypropylene wax, paraffin wax, and the like. In this embodiment, a low-molecular-weight polyethylene wax having the glass transition temperature of 50° C., which is lower than that of the binding resin of the toner 9, and the softening temperature of 70° C. is used. By using such a wax with the softening temperature lower than that of the binding resin, the bonding is increased among the toner particles and the adhesion is increased between the toner 9 and the recording medium P because the wax component is softened at the temperature lower than the softening temperature of the binding resin, and eventually the softening temperature of the toner 9. With such bonding and adhesion increases, the toner 9 is prevented not to bleed and coagulate when the fixing fluid 30 is applied to a toner image, for example. When the wax component is softened as such, from the portion of the wax component, the fixing fluid 30 easily penetrates into the toner particles. As such, when the fixing fluid 30 is applied, the toner 9 is entirely swollen and softened in a short time, and when transferred to the recording medium P, a toner image can be fixed with the adhesion of a satisfactory level. The resulting toner image can be fully vivid and clear with an overlay of toner images.

In addition to a binding resin, a coloring agent, and a release agent, the toner 9 is allowed to contain one or more of a general toner additive, e.g., charging control agent, flowability improver, fixing accelerator, and conductive material. The toner 9 is manufactured by any well-known method, e.g., pulverizing, polymerizing, or coagulating. With pulverizing, agents of a coloring agent, a release agent, and the like are dispersed in a binding resin, and then the dispersion result is pulverized. With polymerizing, monomers of a coloring agent, a release agent, a binding resin and the like are uniformly dispersed, and then the monomers of the binding resin are polymerized. With coagulating, the particles of a binding resin, a coloring agent, a release agent, and the like are coagulated under a coagulating agent, and the coagulated result is then heated. The particles of the toner 9 are preferably not perfectly spherical and may be irregularly spherical for the aim of increasing the surface area. With the irregularly-spherical shape, the particles of the toner 9 easily come in contact with the fixing fluid 30, thereby enabling the consumption reduction of the fixing fluid 30, and the time reduction for fixing and drying of a toner image. The volume average particle diameter of the toner 9 is not specifically restrictive but preferably 2 to 7 μm. If used is a toner with such small-sized particles, the resulting toner image is increased in surface area per unit area, and the area coming in contact with the fixing fluid 30 is accordingly increased. This thus enables the toner 9 to be fixed to the recording medium P in a short time. Such short-time fixing contributes to the consumption reduction of the fixing fluid 30, and the recording medium P can be free from wrinkles and curling because the fixing fluid 30 is dried quickly. The smaller particles of the toner 9 increase the coating ratio with respect to the recording medium P even with the same weight so that the resulting image can be of high quality with less coating mass. That is, the reduction of the toner consumption can be achieved together with the quality increase for images. The volume average particle diameter smaller than 2 μm causes reduction of flowability, and causes lack of a toner supply to the photoreceptor drum during image development, stirring in the developing device, charging of a toner, and the like. This resultantly causes the shortage of a toner, the increase of an opposite-polarity toner, and the like, whereby no high-quality image can be derived at the time of image development. On the other hand, the volume average particle diameter larger than 7 μm increases the percentage of large-sized particles, which are not easily swollen to the core. As a result, the resulting fixed image will not be clear and vivid, and with an OHP sheet, the transparent image looks dim.

The toner 9 includes a binding resin, a pigment (coloring agent), and a wax (release agent), for example, and preferably has the softening temperature of 100 to 130° C., the glass transition temperature of 50 to 80° C., and the volume average particle diameter of 2 to 7 μm. The toner 9 with the high softening temperature indeed shows high durability against the load at the time of image development, but does not fix enough with thermal fixing and the coloring is not satisfactory. Such a toner with the high softening temperature, however, suitably works well with the image forming apparatus 1 using the fixing fluid 30 for forming of high-quality fixed images. This is because with the image forming apparatus 1, the toner is chemically swollen and softened. In this embodiment, the toner 9 contains a coloring agent of 12 wt % and a wax component of 7 wt %, and the remaining is the polyester component, i.e., a binding resin with the glass transition temperature of 60° C. and the softening temperature of 120° C. The toner 9 is of a negative-charging insulating non-magnetic toner with the volume average particle diameter of 6 μm. To derive a predetermined image density using this toner, i.e., the measurement value of reflection density is 1.4 using the X-Rite 310, the toner of 5 g/m$^2$ per unit area is required.

The intermediate transfer section 3 is configured to include the intermediate transfer belt 22, intermediate transfer rollers 23*y*, 23*m*, 23*c*, and 23*b*, support rollers 24, 25, and 26, and a belt cleaner 27.

The intermediate transfer belt 22 is a toner image bearing section, which is an endless belt placed across the support rollers 24, 25, and 26, and forms a loop-shaped path for movement. The intermediate transfer belt 22 rotates in the direction of the arrow 28 at the circumferential speed almost the same as the photoreceptor drums 11*y*, 11*m*, 11*c*, and 11*b*. The intermediate transfer belt 22 is not specifically restrictive as long as it does not allow the fixing fluid 30 to penetrate thereinto, and is exemplarily a laminate. The laminate includes a film substrate, an elastic resin layer formed on the surface of the film substrate, and a fluorine-resin-included coating layer formed on the surface of the elastic resin layer, or a film substrate and a fluorine-resin-included coating layer formed on the surface of the film substrate, for example. The surface of the coating layer serves as a toner image bearing surface 22*a*. The film substrate is made by shaping, like a film, a resin material including polyimide, polycarbonate, or the like, and a rubber material including fluorine rubber. The fluorine-resin-included coating layer includes a fluorine resin such as PTFE (polytetrafluoroethylene), PFA (copolymer of tetrafluoroethylene and perfluoroalkyl vinyl ether), a mixture thereof, and the like. One or more of the film-shaped substrate, the elastic resin layer, and the fluorine-resin-included coating layer may include a conductive material for the aim of controlling the electrical resistance to serve as the intermediate transfer belt 22. The conductive material includes, for example, furnace black, thermal black, channel black, and graphite carbon. The intermediate transfer belt 22 is not necessarily shaped like a belt, and may be shaped like a drum. The intermediate transfer belt 22 for use in this embodiment is shaped like a belt, and is a laminate of a substrate layer and a coating layer thereon, each containing carbon black so as to have an electrical resistance considered appropriate as an intermediate transfer belt. The substrate layer is a polyimide film with the thickness of 100 μm, and the coating layer is made of a fluorine resin composition with the thickness of 20 μm. The fluorine resin composition includes PTFE and PFA at a ratio of 8 to 2 (weight percent).

The toner image bearing surface 22*a* of the intermediate transfer belt 22 is pressed, in this order, against the photoreceptor drums 11*y*, 11*m*, 11*c*, and 11*b* from the upstream in the rotation direction, i.e., the direction of the arrow 28. The positions where the intermediate transfer belt 22 is pressed against the photoreceptor drums 11*y*, 11*m*, 11*c*, and 11*b* are the transfer positions, i.e., intermediate transfer nip portions, for the color-varying toner images to the intermediate transfer belt 22. In this embodiment, the intermediate transfer belt 22 rotates in the direction of the arrow 28 at the circumferential speed almost the same as the photoreceptor drums 11*y*, 11*m*, 11*c*, and 11*b*.

The intermediate transfer rollers 23*y*, 23*m*, 23*c*, and 23*b* are each a roller-shaped member that is so disposed as to be pressed against a surface opposite to the toner image bearing surface 22*a*, and to face the corresponding photoreceptor drums 11*y*, 11*m*, 11*c*, or 11*b* via the intermediate transfer belt 22, and that rotates about an axis thereof by a drive mechanism (not shown). The intermediate transfer rollers 23*y*, 23*m*, 23*c*, and 23*b* are each a roller-shaped member including a metal shaft, and a conductive layer coated over a surface of the metal shaft. The shaft is made of a metal such as stainless steel. The diameter of the shaft is not specifically restrictive, but is preferably 8 to 10 mm. The conductive layer serves to uniformly apply a high voltage to the intermediate transfer belt 22, and is made of a conductive elastic body, for example. The conductive elastic body is preferably the one regularly used in this field, e.g., a conductive material such as carbon black is dispersed in a matrix of ethylene propylene diene rubber (EPDM), forming EPDM, forming urethane, and the like.

To the intermediate transfer rollers 23*y*, 23*m*, 23*c*, and 23*b*, an intermediate transfer bias having a polarity opposite to the charging polarity of the toner is applied under the constant voltage control for toner image transfer in order to transfer the toner images formed on the surfaces of the photoreceptor drums 11*y*, 11*m*, 11*c*, and 11*b* onto the intermediate transfer belt 22. Through such bias application, the toner images of yellow, magenta, cyan, and black formed to the photoreceptor drums 11*y*, 11*m*, 11*c*, and 11*b* are transferred and sequentially overlaid on the intermediate transfer nip portion on the toner image bearing surface 22*a* of the intermediate transfer belt 22 so that a multi-toner image is formed. Note here that when incoming image information is not entirely of yellow, magenta, cyan, and black, a toner image is formed only in the image forming unit(s) corresponding to the color(s) of the incoming image information.

The support rollers 24, 25, and 26 are each disposed to rotate about an axis thereof by a drive mechanism (not shown), and rotate the intermediate transfer belt 22 extending across the support rollers 24, 25, and 26 in the direction of the arrow 28. The support rollers 24, 25, and 26 are each an aluminum-made pipe roller with the diameter of 30 mm and the thickness of 1 mm. The support roller 25 is electrically grounded. The support roller 25 serves also as the transfer section 4 that will be described later.

The belt cleaner 27 is a member for removing any toner remained on the toner image bearing surface 22*a* of the intermediate transfer belt 22 after the toner image thereon is transferred to the recording medium P in the transfer section 4, which will be described later. The belt cleaner 27 includes a cleaning blade 27*a* and a toner container 27*b*. The cleaning blade 27*a* is a plate-like member that is so disposed as to face the support roller 26 via the intermediate transfer belt 22, and to be pressed against the toner image bearing surface 22*a* by a pressing section (not shown). The cleaning blade 27*a* serves to scrape any residual toner, paper dust, and the like, if any, remained on the toner image bearing surface 22*a*. The cleaning blade 27*a* is exemplarily made of a rubber material such as polyurethane rubber. The toner container 27*b* stores therein residual toner, offset toner, paper dust, and the like, which are scraped by the cleaning blade 27*a*.

In the intermediate transfer section 3, the toner images of various colors formed on the photoreceptor drums 11*y*, 11*m*, 11*c*, and 11*b* are transferred and sequentially overlaid on the intermediate transfer nip portion on the toner image bearing surface 22*a* of the intermediate transfer belt 22 so that a toner image is formed. After thus formed toner image is transferred to the recording medium P by the transfer section 4, the belt cleaner 27 removes any toner remained on the toner image bearing surface 22*a* of the intermediate transfer belt 22, and another toner image is continuously transferred to the toner image bearing surface 22*a*.

The transfer section 4 includes the support roller 25 and a transfer roller 29. The transfer roller 29 is a roller-shaped member that serves mainly as a pressure roller. The transfer roller 29 is so disposed as to be pressed against the support roller 25 via the intermediate transfer belt 22, and to rotate about the axis thereof. The transfer roller 29 may be the one regularly used in this field, and in this embodiment, used is a roller-shaped member with a polyurethane rubber layer provided on the surface of a metal core with the diameter of 10 mm. The polyurethane rubber layer includes carbon black, and is 4 mm in thickness. In this embodiment, the transfer roller 29 is pressed against the support roller 25 with a line pressure of 1N/cm, and to the metal core of the transfer roller 29, a transfer bias voltage of +1 kV is applied at the time of toner image transfer to the recording medium P. In the transfer section 4, when a toner image in the swollen/softened state is transported to the portion where the support roller 25 and the transfer roller 29 are pressed against each other, i.e., the transfer nip portion, in synchronization therewith, the recording medium P is fed from the recording medium feeding section 8, which will be described later. The toner image on the intermediate transfer belt 22 is then pressed against the surface of the recording medium P so that the toner image is disposed on the surface of the recording medium P.

The fixing fluid applying section 5 is configured to include a fixing fluid supply section 31, a fixing fluid storage tank 32, a supply pipe 33, and a fixing roller 40. Note that the fixing roller 40 is used as a roller-shaped member for providing the fixing fluid 30 onto the recording medium P in the fixing fluid applying section 5, and for fixing toner images to the recording medium P in the fixing section 7, which will be described later.

The fixing fluid supply section 31 includes a fixing fluid tank 31*a* and a supply roller 31*b*. The fixing fluid tank 31*a* is a container-like member that has a space therein, and houses therein the supply roller 31*b* and the fixing fluid 30. The side surface of the fixing fluid tank 31*a* facing the fixing roller 40 of the fixing fluid tank 31*a* is formed with an aperture portion 31*c*. The supply roller 31*b* is a roller-shaped member that is so disposed as to partially protrude toward outside from the aperture portion 31*c* formed to the fixing fluid tank 31 to be pressed against the surface of the fixing roller 40. In the supply roller 31*b*, another part is dipped in the fixing fluid 30 in the fixing fluid tank 31. The supply roller 31*b* is supported to rotate about an axis thereof, and makes driven rotation due to driving rotation of the fixing roller 40. With such a configuration, the supply roller 31*b* bears on the surface thereof the fixing fluid 30 that is filled in the internal space of the fixing fluid tank 31*a*, and applies the fixing fluid 30 onto the surface of the fixing roller 40 at the portion where the fixing roller 40 is pressed thereagainst. The supply roller 31*b* is a roller-shaped member including a metal core, and a coating layer made of a material having a good affinity for a solvent component (will be described later) included in the fixing fluid 30, for example. The material having a good affinity for the solvent component in the fixing fluid 30 includes silicone rubber, fluorine rubber, polyurethane rubber, and the like. Among these, silicone rubber and fluorine rubber are considered preferable as are low in surface energy and are not easily attached with the toner 9. By the fixing fluid supply section 31, the fixing fluid 30 is supplied to the surface of the fixing roller 40.

The fixing fluid storage tank 32 is a container-like member having an internal space therein, and stores the fixing fluid 30 in the internal space. The fixing fluid storage tank 32 may be stationarily disposed in the inside of the image forming apparatus 1, and when the fixing fluid 30 is consumed, may supply the fixing fluid 30 from a port (not shown) formed thereto to supply the fixing fluid 30. Alternatively, the fixing fluid storage tank 32 may be configured as a cartridge attachable/detachable to/from the image forming apparatus 1, and when the fixing fluid 30 is completely consumed, the fixing fluid storage tank 32 may be exchanged into a new one.

The fixing fluid 30 for storage in the fixing fluid storage tank 32 may be any well-known fluid whatever including a solvent component that can swell/soften the bonding agent, the release agent, and the like included in the toner 9. The most preferable fluid is the one containing one or more of an organic solvent and water. The organic solvent here means the one that can swell/soften a bonding agent, a release agent, and the like, and can be dissolved or dispersed in water, e.g., hydrofluoroether or a mixture of the hydrofluoroether and any other organic solvent (hereinafter, referred to as "auxiliary solvent"). Because the hydrofluoroether is low in surface tension and viscosity, it well penetrates into the areas among the particles and between the toner 9 and the recording medium P, for example. As such, when the fixing fluid 30 is a mixture with an auxiliary solvent, the auxiliary solvent is conveyed to the particle interfaces of the toner 9, the contact surface between the toner 9 and the recording medium P, and the like, so that the toner 9 is instantaneously swollen and softened thereby. Moreover, because the hydrofluoroether is low in latent heat of vaporization, it dries in a short time even at ambient temperature. Examples of the hydrofluoroether include: methyl nonafluorobutyl ether, methyl nonafluoroisobutyl ether ($C_4F_9OCH_3$), ethyl nonafluorobutyl ether, ethyl nonafluoroisobutyl ether ($C_4F_9OC_2H_5$), 1,1,2,2-tetrafluoroethyl 2,2,2-trifluoroethyl ether ($CHF_2CF_2OCH_2CF_3$), and the like. Among them, the hydrofluoroether may be used alone or in combination of two or more. The percentage of the hydrofluoroether is not specifically restricted, but preferably is 50 to 95 wt % of the fixing fluid 30, more preferably 60 to 90 wt %. When the percentage of the hydrofluoroether is lower than 50 wt %, the fixing fluid 30 does not serve well in terms of permeation. With this being the case, when the toner constituting a toner image is large in amount, only the toner facing the outside is swollen and softened, while the toner existing on the contact surface between the toner image and the recording medium P as a toner bearing member is not sufficiently swollen and softened. As a result, the toner image does not attach well to the recording medium P, and thus the resulting image is not securely fixed to the recording medium P. When the percentage of the hydrofluoroether exceeds 90%, the toner 9 is not swollen and softened well enough, and thus the resulting fixing strength is not enough.

The auxiliary solvent includes alcohol (e.g., methanol, ethanol, propanol, isopropanol, and butanol), ketone (e.g., acetone, methyl ethyl ketone, methyl butyl ketone, methyl isobutyl ketone, and diethyl ketone), ether (e.g., methyl ethyl ether, diethyl ether, methyl butyl ether, methyl isobutyl ether, and dimethyl ether), carboxylic acid (e.g., formic acid, acetic acid, propionic acid, and butyric acid), ester with lower alcohol (e.g., methanol, ethanol, and propanol), and the like. Most of all, the ether and the ester are considered preferable, and the ester is especially preferable. In the ether, diethyl ether is especially preferable. In the ester, ethyl acetate, methyl acetate, ethyl formate, and methyl formate are considered preferable, for example, and ethyl acetate is especially preferable. These auxiliary solvents are vaporized at ambient temperature, and serve excellent to swell and soften a binding resin in the toner 9 such as polyester. Among them, the auxiliary solvent may be used alone or in combination of two or more. The percentage for use between the hydrofluoroether and the auxiliary solvent is not specifically restrictive, but 1 to 100 wt % of the auxiliary solvent is preferable with respect to 100 wt % of hydrofluoroether. The percentage of the auxiliary solvent in the fixing fluid 30 is preferably 5 wt % or more of the fixing fluid 30, and more preferably 10 wt % or more on the condition that the percentage of the hydrofluoroether is satisfied. The amount of water for use is the remaining of the total amount, i.e., the amount after subtracting, from 100, the amount of an organic solvent or a mixture of an organic solvent and an auxiliary solvent.

The fixing fluid 30 is allowed to contain a surfactant, a dispersing aid, and the like in addition to the water and the organic solvent. The surfactant helps the organic solvent to disperse in the fixing fluid 30, and increases the wettability between the toner 9 and the fixing fluid 30. Examples of the surfactant include: anionic surfactants for example, higher alcohol sulfate such as sodium lauryl sulfate, higher fatty acid metal salt such as sodium oleate, fatty acid derivative sulfuric ester salt, and phosphoric ester; cationic surfactants, for example, quaternary ammonium salt and heterocyclic amine; amphoteric surfactants, for example, amino acid ester and amino acid; non-ionic surfactants, polyoxyalkylene alkylether, polyoxyethylene alkylamine, and the like. Among them, the surfactant may be used alone or in combination of two or more. Examples of the dispersing aid include coupling agents such as diethylene glycol, triethylene glycol, polyethylene glycol, monobutyl ether, diethylene glycol monomethyl ether, and the like. Among them, the dispersing aid may be used alone or in combination of two or more. The fixing fluid 30 is allowed to contain an adhesive. The adhesive is not specifically restrictive as long as it can be dissolved or dispersed in the fixing fluid 30, e.g., rubber adhesive mainly including polymeric elastomer such as chloroprene rubber, nitrile rubber, and SBR (styrene-butadiene rubber); emulsion adhesive in which synthetic resin such as vinyl acetate, EVA (ethylene vinyl acetate), and acrylic resin, and the like, is uniformly dispersed in water. As such, the adhesion between the toner 9 and the recording medium P is enhanced not only by the toner being swollen and softened but also by the adhesive so that the adhesion can be improved between the toner 9 and the recording medium P, and the fixing strength of a toner image to the recording medium P can be increased.

The supply pipe 33 is a pipe-like member whose one end is connected to the fixing fluid supply section 31, and the other end is connected to the fixing fluid storage tank 32 for supply of the fixing fluid 30 in the fixing fluid storage tank 32 to the fixing fluid tank 31*a*. The supply pipe 33 is provided thereon with a fixing fluid replenishing section (not shown). The fixing fluid 30 is replenished based on the remaining amount of the fixing fluid 30, which is detected by a liquid amount detection section (not shown) provided to the fixing fluid tank 31*a*, for example. The result obtained by the liquid amount detection section is sent to a storage portion of the control unit 60, which exercises control over the entire operation of the image forming apparatus 1. In the control unit 60, a calculation portion retrieves, from the storage portion, the replenishment-needed amount of the fixing fluid that is previously stored in the storage portion, and the result obtained by the liquid amount detection section and compares them. When determining that the current amount of the fixing fluid 30 is less that the replenishment-needed amount, the control unit 60 sends a control signal to the fixing fluid replenishing section for replenishing the fixing fluid 30 to the fixing fluid supply section 31. The replenishment of the fixing fluid 30 is made, for example, based on the result obtained by the liquid amount detection section. When determining that the fixing fluid supply section 31 is filled with the fixing fluid 30 of a predetermined amount, the control unit 60 sends a control signal to the fixing fluid replenishing section so that the replenishment of the fixing fluid 30 is stopped. The fixing fluid replenishing section may be used with an electromagnetic valve, for example.

In this embodiment, a fixing fluid temperature keeping section (not shown) is provided in the inside of and/or proximal to at least one of the components, i.e., the fixing fluid supply section 31, the fixing fluid storage tank 32, and the supply pipe 33. The fixing fluid temperature keeping section is provided to keep the temperature of the fixing fluid 30 higher than the ambient temperature, and at the level of not encouraging the organic solvent or the like to vaporize in the fixing fluid 30. Specifically, the fixing fluid temperature keeping section is a general heating section such as various types of heater. The fixing fluid temperature keeping section is under the control by the control unit 60 in terms of heating, i.e., based on the result of a temperature sensor (not shown) provided to the any of fixing fluid supply section 31, the fixing fluid storage tank 32, and the supply pipe 33, for example. Herein, the target temperature to keep is set in advance based on the composition of the fixing fluid 30.

Referring to FIG. 4, the fixing roller 40 is a roller-shaped member that is supported by a drive mechanism (not shown) to rotate about an axis thereof, and is so disposed as to be pressed against the pressure roller 44. The fixing roller 40 is configured to include a metal core 41, an elastic layer 42 formed on the surface of the metal core 41, and a surface layer 43 formed on the surface of the elastic layer 42. The elastic layer 42 is made of an elastic material, which is preferably a rubber material, and it is especially preferable if the rubber material is not swollen by the fixing fluid 30. If with a rubber material that does not swell by the fixing fluid 30, the outer diameter of the fixing roller 40 can remain the same so that the recording medium P can be transported at almost the same speed in the portion where the fixing roller 40 and the pressure roller 44 are pressed against each other, i.e., fixing nip portion. The rubber material that does not swell by the fixing fluid 30 includes, for example, ethylene propylene rubber (EPDM), butyl rubber, nitrile rubber, chloroprene rubber, and styrene-butadiene rubber. The surface layer 43 is made of a synthetic resin, preferably a fluorocarbon resin. Examples of the fluorocarbon resin include PTFE (polytetrafluoroethylene), PFA (copolymer of tetrafluoroethylene and perfluoroalkyl vinyl ether), FEP (copolymer of tetrafluoroethylene and hexafluoropropylene), ETFE (copolymer of tetrafluoroethylene and ethylene), PVDF (polyvinylidene fluoride), PCTFE (polychlorotrifluoroethylene), a mixture of two or more of these, and the like. In the fixing roller 40 in this embodiment, on the surface of the metal core 41 is formed the elastic layer 42 made of an EPDM (ethylene propylene terpolymer) rubber with the hardness of 20 (JIS-A) and the thickness of 3 mm. On the surface of the elastic layer 42, the surface layer 43 is made of PFA with the thickness of 80 μm. The fixing roller 40 has the outer diameter of 30 mm.

In the fixing fluid applying section 5, the fixing fluid 30 stored in the fixing fluid storage tank 32 is supplied to the fixing fluid tank 31*a* of the fixing fluid supply section 31 via the supply pipe 33, and makes the fixing fluid 30 attach to the surface of the fixing fluid supply roller 31*b*. The fixing fluid supply roller 31*b* makes the fixing fluid 30 attach to the surface of the fixing roller 40 at the portion where the fixing roller 40 is pressed thereagainst. As will be described later, the fixing roller 40 applies the fixing fluid onto the recording medium P at the portion where the pressure roller 44 is pressed thereagainst.

Referring to FIGS. 1 and 3, the transport section 6 includes a transport belt 34, a drive roller 35, a tension roller 37, and a temperature sensor 38. The transport 34 is an endless belt extending across the drive roller 34 and the tension roller 37, and is formed in a loop-shape. The transport section 6 directs the recording medium P in the direction of an arrow 39, i.e., toward the fixing section 7, while heating the recording medium P, which bears thereon a toner image transferred by the transfer section 4. The transport belt 34 may be the one including a PTFE-made layer with the thickness of 10 μm coated over a polyimide film at least on the surface over which the recording medium passes. The polyimide film is made conductive as is added with a conductive material, and has the thickness of 100 μm.

The drive roller 35 is a roller-shaped member that is so disposed as to rotate about an axis thereof by a drive mechanism (not shown). The drive roller 35 may be a hollow roller made of a metal such as aluminum. In the inside of the drive roller 35, a heating section 36 is provided. The heating section 36 uses the control unit 60 (will be described later) to keep substantially constant the temperature of the transport belt 34, which is placed on the drive roller 35. The recording medium P with a toner image thereon is indirectly heated by the transport belt 34 after being forwarded thereto. Because the recording medium P with a toner image thereon is small in thermal capacity, the medium can be heated to any desired temperature with less amount of heat, thereby favorably preventing the increase of power consumption. In a case where the fixing fluid 30 is applied to the recording medium P that is currently heated with a toner image thereon, the fixing fluid 30 quickly disperses and permeates the recording medium immediately after being applied. Accordingly, with the application of the fixing fluid 30, the toner 9 is instantaneously swollen and softened over the wide area so that the bleeding and coagulation of the toner 9 can be prevented. As a result, the resulting image can be good in quality with the high fixing strength. Moreover, the fixing fluid 30 is increased in temperature when coming in contact with the recording medium P with a toner image thereon, and thus any not-needed fixing fluid 30 is dried in a short time. This can increase the throughput, which is the pieces of paper to be outputted from the image forming apparatus 1 per unit. The heating section 36 may be a non-contact heater such as halogen lamp or infrared heater, and may be shaped like a roller or a plate, for example. In this embodiment, the heating section 36 is a halogen lamp, the transport belt 34 is kept at 70° C. in temperature, and the toner image on the recording medium P is heated to the temperature, i.e., about 56° C., slightly lower than the glass transition temperature, i.e., 60° C., of the toner 9. The tension roller 37 gives tension of a predetermined level to the transport belt 34 not to loosen the transport belt 34.

The tension roller 37 includes a metal shaft, and a coated layer formed on the surface of the metal shaft, for example. Alternatively, the tension roller 37 may be configured only by the metal shaft. The metal shaft may be made of stainless steel, and the coated layer may be made of fluorine rubber, for example. The temperature sensor 38 is disposed on the downstream side of the drive roller 35 in the transport direction of the transport belt 34, i.e., direction of the arrow 39, in the vicinity of the surface opposite to the surface of the transport belt 34 over which the toner-image-borne recording medium P passes. The result obtained by the temperature sensor 38 is inputted to the storage portion of the control unit 60. The calculation portion of the control unit 60 retrieves, from the storage portion the previously-set temperature of the transport belt 34, and the result obtained by the temperature sensor 38 and compares them. When determining that the result is lower than the previously-set temperature, the control unit 60 accordingly sends a control signal to a power supply (not shown) of the heating section 36. The power supply then applies a voltage of any needed level to the heating section 36 so that the heating section 36 generates heat. As such, the temperature of the transport belt 34 is kept substantially constant.

In this embodiment, the temperature of the transport belt 34 is set to 70° C., and the temperature of a toner image onto which the fixing fluid 30 is applied and which is transported to the fixing section 7, is set to a temperature lower than the glass transition temperature (60° C.) of the toner 9. Such temperature setting is surely not restrictive, and the temperature of the transport belt 34 may be set to 80° C., and the temperature of a toner image may be set higher than the glass transition temperature (60° C.) of the toner 9 before being transported to the fixing section 7. This accordingly softens the toner 9 before the application of the fixing fluid 30, and the bonding is increased among the toner particles and the adhesion is increased between the toner 9 and the recording medium P. As such, at the time of application of the fixing fluid 30, the bleeding and coagulation of the toner caused by the application of the fixing fluid can be prevented. Preferably, the temperature of the transport belt 34 is set to 140° C., and the temperature of a toner image may be set higher than the softening temperature (120° C.) of the toner 9 before being transported to the fixing section 7. This accordingly softens better the toner 9, and the bonding is increased to a further extent among the toner particles and the adhesion between the toner 9 and the recording medium P. As such, at the time of application of the fixing fluid 30, the bleeding, the coagulation, and the like of the toner can be better prevented without fail. In the transport section 6, by applying the fixing fluid 30 to the recording medium P transferred with a toner image by the transfer section 6 while heating the recording medium P at the set-temperature, the toner constituting the toner image is fully swollen and softened. Thereafter, the toner-image-borne recording medium P is forwarded to the fixing section 7.

Referring to FIG. 3, the fixing section 7 includes the fixing roller 40, the pressure roller 44, and paper ejection rollers 45. The fixing roller 40 is as described above. The pressure roller 44 is a roller-shaped member that is supported to rotate together with the fixing roller 40, and is so disposed as to be pressed against the fixing roller 40. Similarly to the fixing roller 40, the pressure roller 44 includes a metal core, an elastic layer, and a surface layer. In the pressure roller 44, the materials of the metal core, the elastic layer, and the surface layer are similar to those of the fixing roller 40. In this embodiment, on the surface of the metal core is formed the elastic layer made of an EPDM (ethylene-propylene terpolymer) rubber with the hardness of 50 (JIS-A) and the thickness of 3 mm. On the surface of the elastic layer, the surface layer made of PFA is formed with the thickness of 80 μm. The pressure roller 44 has the outer diameter of 30 mm. In this embodiment, the pressure roller 44 is pressed against the fixing roller 40 with the pressure of 10 N/cm. In a case where the recording medium P which is heated by the transport section 6 and bears a toner image composed of the toner 9 thereon passes through the portion where the fixing roller 40 and the pressure roller 44 are pressed against each other, i.e., fixing nip portion, the fixing roller 40 applies the fixing fluid 30 to the toner image on the recording medium P, and the toner 9 constituting the toner image is swollen and softened. At the same time, the toner image is pressed against the recording medium P by the fixing roller 40 and the pressure roller 44, and is fixed to the recording medium P as an image.

The paper ejection rollers 45 are provided as a pair of roller-shaped members, serving to eject, onto a paper ejection tray 49, the image-fixed recording medium P coming from the fixing nip portion between the fixing roller 40 and the pressure roller 44. The paper ejection tray 49 is provided to the external side surface of the image forming apparatus 1. Such a pair of rollers are so disposed as to be pressed against each other, and are supported to rotate around the respective axes thereof. In the fixing section 7, when the toner-image-borne recording medium P passes through the fixing nip portion, the toner image is applied with the fixing fluid 30 and the pressure so that the toner image is fixed to the recording medium P as an image. The resulting image is ejected onto the ejection tray 49 via the paper ejection rollers 45. In the fixing section 7, by applying the fixing fluid 30 and the pressure at the same time, the resulting image can be much increased in fixing strength, quality, and the like.

Referring to FIG. 1, the recording medium feeding section 8 includes a recording medium cassette 46, a pickup roller 47, and a pair of registration rollers 48. The recording medium cassette 46 stores therein the recording medium P, and the pickup roller 47 forwards the recording medium P piece by piece to the transport path. The registration rollers 48 forward the recording medium P to the transfer nip portion in synchronization with the transportation of the toner image on the intermediate transfer belt 22 to the transfer nip portion. In the recording medium feeding section 8, the recording medium P stored in the recording medium cassette 46 is forwarded to the transport path by the pickup roller 47 piece by piece, and then to the transfer nip portion by the registration rollers 48. As such, toner image transfer is performed.

The recording medium detection section 50 is disposed in the recording medium feeding section 8 and in the vicinity of the recording medium transport path extending between the pickup roller 47 and the registration rollers 48. The recording medium detection section 50 detects the type of the recording medium P, and inputs the result to the storage portion of the control unit 60. Alternatively, in an operation panel (not shown) disposed on the upper surface portion (not shown) of the image forming apparatus 1, an area may be provided for defining the recording medium P by the type, and a user may specify the type of the recording medium P for input to the control unit 60. Still alternatively, from the image information provided to the control unit 60 from any external information terminal connected to the image forming apparatus 1, the control unit 60 may retrieve any information related to the type of the recording medium P for type detection thereof. The type of the recording medium P includes the material, the thickness, the marking, and the like.

In the image forming apparatus 1, based on the result obtained by the recording medium detection section 50, the control unit 60 exercises control over the amount of fixing fluid for application to the toner-image-borne recording medium P. Herein, the CPU serves as the fixing fluid control section. In this embodiment, as the recording medium detection section 50, a paper-thickness detection sensor is used. Examples of the paper-thickness detection sensor include an optical sensor such as a reflective sensor and a sensor which irradiates the recording medium P with light from an LED, and detects the thickness, the material, and the like thereof from the amount of reflected light; a marking sensor which reads any marking on the recording medium P, and detects the material, the thickness, and the like thereof; an ultrasound sensor; and the like. In this embodiment, as described above, the recording medium detection section 50 is disposed in the recording medium feeding section 8 and in the vicinity of the recording medium transport path extending between the pickup roller 47 and the registration rollers 48. This is surely not restrictive, and the recording medium detection section 50 may be disposed in the vicinity of the recording medium transport path extending between the transfer nip portion and the registration rollers 48, in the vicinity of a portion on the transport belt 34 where the recording medium P is disposed, and the like.

The control unit 60 functions as the fixing fluid control section. In a case where the recording medium detection section 50 detects the thickness of the recording medium P, the application amount of fixing fluid is controlled as below. The recording medium P is exemplified by plain paper, color copy paper, an OHP sheet, coated paper, and the like, and is varying in thickness. The thickness and the material of the recording paper P vary the permeating level and speed of the fixing fluid 30 to the recording medium P. For example, when the thickness of the recording medium P is small, it is possible to decrease the application amount of fixing fluid, but when the thickness of the recording medium P is large, it is necessary to increase the application amount of he fixing fluid. As such, the thickness and the material of the recording medium P are used as basis for determining the appropriate application amount of fixing fluid, and thus determined value is inputted in advance as a data table to the storage portion of the control unit 60. Exemplified below is the application amount of fixing fluid to plain paper. In a case of general plain paper having the thickness of about 0.09 mm, the application amount is about 2.5 mg/cm$^2$, in a case of thin paper having the thickness of about 0.07 mm, the application amount is about 0.5 mg/cm$^2$, and in a case of thick paper having the thickness of about 0.2 mm, the application amount is about 3.5 mg/cm$^2$. Considered here is a case where the recording medium P has the thickness of about 0.09 mm and is hardly permeated with the fixing fluid 30, e.g., an OHP sheet or coated paper. In such a case, when the application amount of fixing fluid is about 2.5 mg/cm$^2$ as for plain paper, the fixing fluid 30 flows over the surface of the recording medium P, and the toner 9 starts bleeding and coagulating, thereby considerably lowering the image reproducibility and the quality. As such, in a case of an OHP sheet or coated paper, the application amount of fixing fluid is set about 0.5 mg/cm$^2$.

By selecting any appropriate application amount of fixing fluid based on the thickness and/or the material of the recording paper P, wrinkles, bleeding and coagulation of a toner, and not-sufficient fixing strength which are caused by the application of a fixing fluid are prevented. This also favorably enables to form high-quality images with the image reproducibility of a satisfactory level. What is better, because the application amount of fixing fluid 30 can be optimum for every recording paper P so that the fixing fluid 30 can be used efficiency with no waste, and the consumption of the fixing fluid can be reduced. The application amount of fixing fluid can be controlled by changing the rotation circumferential speed of the fixing roller 40, for example. That is, when the rotation circumferential speed of the fixing roller 40 is increased, the application amount of fixing fluid is increased, and when the rotation circumferential speed of the fixing roller 40 is decreased, the application amount of fixing fluid is decreased. The application amount of fixing fluid varies depending on the surface material of the fixing roller 40, the outer diameter thereof, and the like. As such, after the fixing roller 40 is selected, a relationship between the rotation circumferential speed and the application amount of fixing fluid is measured by experiment with respect to the selected fixing roller 40, and the relationship is inputted in advance to the storage portion of the control unit 60 as a data table. When the storage portion receives the result obtained by the recording medium detection section 50, i.e., the thickness of the recording medium P, the calculation portion of the control unit 60 retrieves, from the storage portion, the result and the data table and compares them. Through comparison as such, the calculation portion determines the appropriate application amount of fixing fluid, and the appropriate rotation circumferential speed for the fixing roller 40. Based on the determination result derived by the calculation portion, the control portion of the control unit 60 sends a control signal to a power supply (not shown) which makes a supply of driving power to a drive mechanism (not shown) which rotates the fixing roller 40, and changes the rotation circumferential speed of the fixing roller 40. Through such speed change, the application amount of fixing fluid can be controlled in accordance with the thickness of the recording medium P.

The control unit 60 functions also as a transport speed control section, which exercises control over the transport section 6 in terms of the transport speed for the toner-image-borne recording medium P. Such control is exercised in accordance with the result obtained by the recording medium detection section 50. In this case, the result obtained by the recording medium detection section 50 is preferably about the material of the recording medium P. That is, based on the material of the recording medium P, the rotation drive speed, i.e., transport speed, of the transport belt 34 is controlled in the transport section 6. Although the toner-image-borne recording medium P is passed over the transport belt 34 that is being heated at the constant temperature, some material of the recording medium P may change the amount of heat to be transmitted to the toner image, the toner image may be changed in state immediately before being guided to the fixing nip portion, and the fixing strength may show a slight decrease even with the appropriate application amount of fixing fluid. However, these can be solved by control exercised over the transport belt 34 in terms of the transport speed based on the material of the recording medium P. With such control exercise, irrespective of the material of the recording medium P, the toner image remains in the same state when guided to the fixing nip portion, and the toner image is fixed to the recording medium P. As such, any appropriate transport speed is determined in accordance with the material of the recording medium P and the heating temperature of the transport belt 34, and the resulting value is inputted in advance to the storage portion of the control unit 60 as a data table.

In this embodiment, the appropriate transport speed is about 100 mm/sec for the recording medium P being plain paper, and is about 500 mm/sec for the recording medium P being an OHP sheet, coated paper, and the like, which is hardly or not at all permeated with the fixing fluid 30. The transport speed can be controlled by changing the rotation circumferential speed of the drive roller 35. With the higher rotation circumferential speed of the drive roller 35, the transport speed is increased, and with the lower rotation circumferential speed of the drive roller 35, the transport speed is decreased. In consideration thereof, the relationship is measured between the rotation circumferential speed and the transport speed of the drive roller 35, and the measurement result is inputted in advance to the storage portion of the control unit 60 as a data table. When the result, i.e., the material of the recording medium P, derived by the recording medium detection section 50 is inputted to the storage portion, the calculation portion of the control unit 60 retrieves, from the storage portion, the result and the data table and compares them, and determines the appropriate rotation circumferential speed for the drive roller 35. Based on the determination result derived by the calculation portion, the control portion of the control unit 60 sends a control signal to a power supply (not shown) which makes a supply of driving power to a drive mechanism (not shown) which rotates the drive roller 35, and changes the rotation circumferential speed of the drive roller 35. Through such speed change, the transport speed can be controlled in accordance with the material of the recording medium P.

The image forming apparatus 1 is equipped with the control unit 60. The control unit 60 is disposed to the upper portion in the internal space of the image forming apparatus 1, for example, and includes the control portion, the calculation portion, the storage portion, and the like, is a processing circuit realized by a microcomputer equipped with a control processing unit (CPU). The storage portion of the control unit 60 receives an image forming command issued via an operation panel (not shown) disposed on the upper surface of the image forming apparatus 1, results coming from sensors (not shown) located at various portions in the image forming apparatus 1, image information coming from any external equipment, and the like. On the basis of such incoming various data, i.e., image forming command, results, and image information, the calculation portion makes a determination, and the control portion sends a control signal based on the determination result derived by the calculation portion. As such, the image forming apparatus 1 is put under the control of the entire operation. The storage portion is the one regularly used in this field, e.g., read-only memory (ROM), random access memory (RAM), and hard disk drive (HDD). The external equipment is electric or electronic equipment that is capable of forming or acquiring image information, and of being electrically connected to the image forming apparatus, e.g., computer, digital camera, television receiver, videocassette recorder, DVD (digital versatile disc) recorder, and facsimile machine. The control unit 60 includes a power supply together with the above-described processing circuit, and the power supply makes a power supply not only to the control unit 60 but also to the components in the image forming apparatus 1.

In the image forming apparatus 1, a toner image formed by the toner image forming section 2 on the intermediate transfer belt 22 is transferred to the recording medium P by the transfer section 4 so that a toner-image-borne recording medium P is obtained. The toner-image-borne recording medium P is heated at any appropriate temperature while being directed toward the fixing nip portion by the transport section 6, and receives the fixing fluid 30 and the pressure in the fixing nip portion by the fixing fluid applying section 5. This makes the toner image fixed to the recording medium P, and the result is ejected onto the paper ejection tray 49. During such an operation, the recording medium detection section 50 disposed in the vicinity of the recording medium transport path detects a thickness, a material, and the like of the recording medium P. Based on the result, control is exercised over the application amount of the fixing fluid 30, the transport speed of the recording medium P in the transport section 6, and the like.

Figure 5:
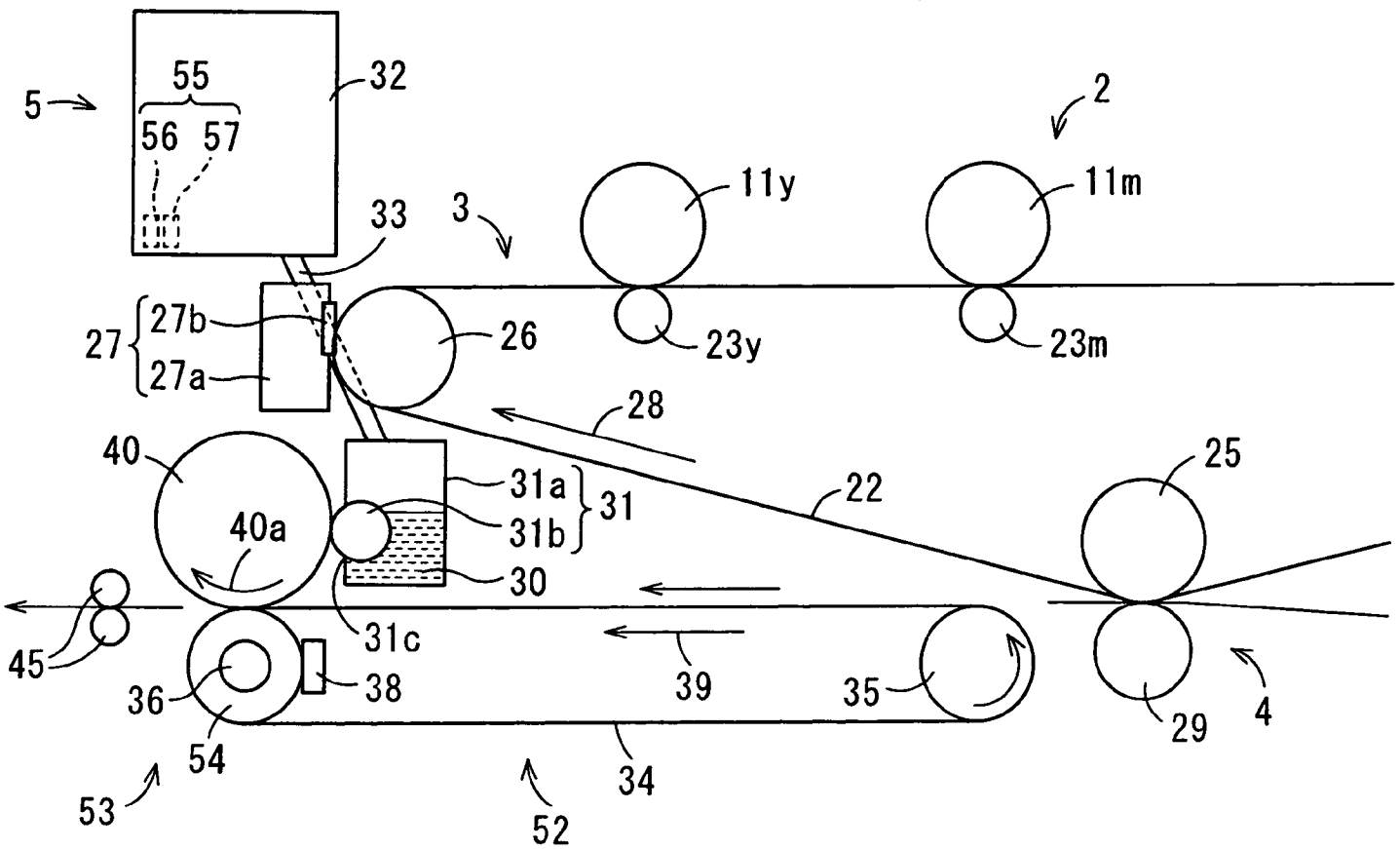
FIG. 5 is a cross sectional view schematically showing the configuration of a main component of an image forming apparatus according to a second embodiment of the invention.

FIG. 5 is a cross sectional view schematically showing the configuration of a main component of an image forming apparatus 51 according to a second embodiment of the invention. The image forming apparatus 51 is similar to the image forming apparatus 1, and any components similar to those in the image forming apparatus 1 is denoted by the same reference numeral or not shown and not described again. In the image forming apparatus 51, as alternatives to the transport section 6 and the fixing section 7 in the image forming apparatus 1, a transport section 52 and a fixing section 53 are provided, and a fixing fluid temperature keeping section 55 is disposed in the fixing fluid storage tank 32 of the fixing fluid applying section 5.

In the fixing fluid applying section 5, the fixing fluid temperature keeping section 55 is disposed in the inside of the fixing fluid storage tank 32 for the purpose of keeping constant the temperature of the fixing fluid 30. The fixing fluid temperature keeping section 55 is configured to include a temperature sensor 56 and a heating section 57. The heating section 57 is a heater. The result obtained by the temperature sensor is sent to the storage portion of the control unit 60, and the calculation portion of the control unit 60 retrieves, from the storage portion, the target temperature that is previously stored in the storage portion, and the result obtained by the temperature sensor 56, and compares them. When the result by the temperature sensor 56 is determined as being lower than the target temperature, a control portion of the control unit 60 sends a control signal to a power supply which makes a power supply to the heating section 57 to increase the temperature of the fixing fluid 30 up to the target temperature. In this embodiment, the target temperature for the fixing fluid 30 is 40° C. Such a configuration favorably prevents the toner 9 from being reduced in temperature too much at the time of application of the fixing fluid 30, and a synergy effect is observed at the time of image fixing between the toner softening by the heat and the toner softening by the fixing fluid so that the resulting image can be satisfactorily fixed.

The transport section 52 includes the transport belt 34, the drive roller 35, a tension roller 54, and the temperature sensor 38. The tension roller 54 is so disposed as to rotate about an axis thereof by a drive mechanism (not shown), or to be rotated together with the drive roller 35. The tension roller 54 works together with the drive roller 35 to extend the transport belt 34 thereacross. The tension roller 54 is so disposed as to be pressed against the fixing roller 40 in the fixing section 53 via the transport belt 34, and the heating section 36 is disposed in the inside of the tension roller 54. That is, with the function of applying a tension to the transport belt 34 in the transport section 52, and with the function of heating the transport belt 34 at the target temperature, the tension roller 54 also serves as a pressure roller in the fixing section 53. The temperature sensor 38 is disposed in the vicinity of the surface of the tension roller 54 for detecting the surface temperature of the tension roller 54. The correlation between the tension roller 54 and the transport belt 34 in terms of the surface temperature can be found in advance. Accordingly, through control exercise over the surface temperature of the tension roller 54, the surface temperature of the transport belt 34 can be controlled. Because the temperature of a toner image becomes substantially the same as the surface temperature of the transport belt 34, by controlling the surface temperature of the transport belt 34, the temperature of a toner image to be directed to the fixing section 53 can be controlled. As to the control exercise over the surface temperature of the tension roller 54, similarly to the temperature control over the transport belt 34 in the image forming apparatus 1, the control unit 60 determines the result obtained by the temperature sensor 38, and based on the determination result, the control unit 60 sends a control signal to a power supply (not shown) connected to the heating section 36. In this embodiment, the surface temperature of the tension roller 54 is set to 70° C., and the temperature of an area for application of the fixing fluid in the transport belt 34 is so set as to be slightly lower than the glass transition temperature (60° C.), of the toner 9. As such, the temperature of a toner image to be directed to the fixing section 53 becomes almost the same as the temperature of the fixing fluid application area in the transport belt 34.

In this embodiment, the surface temperature of the tension roller 54 is set to 70° C., and the temperature of a toner image for transfer to the fixing section 53 is so set as to be slightly lower than the glass transition temperature (60° C.), of the toner 9. This is surely not restrictive, and the surface temperature of the tension roller 54 may be set to 80° C., and the surface temperature of the transport belt 34 may be so set as to be higher than the glass transition temperature (60° C.), of the toner 9, for example. With this being the case, the toner 9 starts softening before the fixing fluid 30 is applied, and the bonding is increased among the toner particles and the adhesion between the toner 9 and the recording medium. This thus enables to prevent, without fail, the bleeding, the coagulation, and the like of the toner possibly caused by the application of a fixing fluid. What is more, the surface temperature of the tension roller 54 may be so set as to be 140° C., and the surface temperature of the transport belt 34 may be set higher than the softening temperature (120° C.), of the toner 9. In this case, the toner 9 is sufficiently softened, and the bonding is increased to a further extent among the toner particles and the adhesion between the toner 9 and the recording medium. This thus enables to better prevent, without fail, the bleeding, the coagulation, and the like of the toner possibly caused by the application of the fixing fluid 30.

Such a configuration allows a supply of, at the spot, the amount of heat to compensate the temperature reduction occurred to the toner 9 and the recording medium P caused by the application of the fixing fluid 30. This accordingly increases, to the appropriate level, the temperatures of the toner 9, the recording medium P, and the fixing fluid 30 immediately after the fixing fluid 30 is applied. The fixing fluid 30 thus becomes fast to disperse and permeate the toner image so that the toner 9 swells and softens instantaneously over the wide area. As such, the toner image can be fixed to the recording medium P with the adhesion of a sufficient level. What is more, as is increased in temperature after application, the fixing fluid 30 having nothing to do with the swelling and softening of the toner 9 can be dried in a short time.

In the transport section 52, after a toner image is transferred to the recording medium P in the transfer section 4, when the resulting toner-image-borne recording medium P is disposed on the transport belt 34 and is directed in the direction of the arrow 39, the recording medium is indirectly heated with the toner image by the transport belt 34. With such heating, the bonding is increased among the particles of a toner 9 constituting the toner image, and the adhesion is increased between the toner 9 and the recording medium P. Such a toner-image-borne recording medium P is directed to the fixing section 53 for application of the fixing fluid 30 and the pressure so that the toner image is fixed to the recording medium P.

The fixing section 53 is configured to include the fixing roller 4, the tension roller 54, and the paper ejection rollers 45. As described above, the tension roller 54 serves as a heating roller. On the way from the transport section 52 to the portion where the fixing roller 4 and the tension roller 54 are pressed against each other, i.e., a fixing nip portion, the toner-image-borne recording medium P is heated and applied with pressure in this fixing nip portion. This accordingly fixes a toner image to the recording medium P with the higher strength, and an image is formed on the recording medium P. The image-formed recording medium P is ejected, via the paper ejection rollers 45, onto a paper ejection tray (not shown), which is disposed outside of the image forming apparatus 51.

In the image forming apparatus of the invention, the material, the layer configuration, the dimension, and the like are not restrictive to those described above for the intermediate transfer belt, the transport belt, the rollers, and the like, and such components may be those often used in the electrophotographic image forming field as they are or with any appropriate modification. The rollers may be each replaced with an endless-loop member such as belt. Although the intermediate transfer belt and the transport belt are described as being endless, such rollers may be each shaped like a roller. The image forming apparatus of the invention is described in the embodiments as being of tandem configuration. This is surely not restrictive, and the image forming apparatus may be of a so-called four-cycle color image forming apparatus, i.e., an image of a single color is overlaid on another when the intermediate transfer belt rotates once. The color image forming apparatus is not the only option, and a single-color image forming apparatus will also do. Such an image forming apparatus of the invention is used as a copier, a printer, a facsimile machine, and a machine with two or more of these.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus, comprising:

a toner image forming section that forms a toner image;

a transfer section that transfers, onto a recording medium, a toner image formed by the toner image forming section;

a fixing fluid applying section that applies to the toner image on a surface of the recording medium, a fixing fluid including water and an organic solvent that softens and/or swells a toner to fix the toner to the recording medium;

a heating section that heats the recording medium;

a recording medium detection section that detects any information about the recording medium; and a fixing fluid control section that causes the fixing fluid applying section to control the amount of fixing fluid for application to the toner image, based on the result obtained by the recording medium detection section.

2. The image forming apparatus of claim 1, wherein the recording medium detection section detects a thickness of a recording medium.

3. The image forming apparatus of claim 1, wherein the recording medium detection section detects a material of a recording medium.

4. The image forming apparatus of claim 3, further comprising:

a transport section that transports a recording medium; and a transport speed control section that causes the transport section to control a transport speed of the recording medium, wherein in accordance with the result obtained by the recording medium detection section that the recording medium is a plastic sheet or coated paper, the transport speed control section controllably sets the transport speed of the recording medium by the transport section to a lower speed compared with the case of a recording medium being detected as plain paper.

5. The image forming apparatus of claim 1, wherein the heating section heats a recording medium until the temperature reaches a value higher than a glass transition temperature of a toner constituting a toner image.

6. The image forming apparatus of claim 1, wherein the heating section heats a recording medium to a temperature higher than a softening temperature of a toner constituting a toner image.

7. The image forming apparatus of claim 1, wherein heating by the heating section and application of a fixing fluid by the fixing fluid applying section are executed to at least a toner image formation area in the recording medium.

8. The image forming apparatus of claim 1, wherein the fixing fluid applying section further includes a fixing fluid temperature keeping section that keeps a temperature of the fixing fluid before application to the recording medium.

9. The image forming apparatus of claim 1, wherein the fixing fluid further includes an adhesive for increasing adhesion of a toner to a recording medium.

10. The image forming apparatus of claim 1, wherein the toner includes a polyester component, and a wax component whose glass transition temperature is lower than that of the polyester component.

11. The image forming apparatus of claim 1, wherein a volume average particle diameter of a toner is 2 to 7 μm.

* * * * *